US005106388A

United States Patent [19]

Sütterlin et al.

[11] Patent Number: 5,106,388

[45] Date of Patent: Apr. 21, 1992

[54] PROCESS FOR PRINTING CELLULOSIC TEXTILE MATERIAL WITH REACTIVE DYES: PRINT PASTE FREE OF UREA; WETTING OF DRIED PRINTED FABRIC PRIOR TO FIXING

[75] Inventors: Wolfgang Sütterlin, Lörrach-Haagen; Hanspeter Hermann, Lörrach, both of Fed. Rep. of Germany; Andres Schaub, Biel-Benken, Switzerland

[73] Assignee: Ciba-Geigy Corporation, Ardsley, N.Y.

[21] Appl. No.: 648,953

[22] Filed: Feb. 1, 1991

[30] Foreign Application Priority Data

Feb. 6, 1990 [CH] Switzerland ..... 90376

[51] Int. Cl.[5] ..... D06P 3/66

[52] U.S. Cl. ..... 8/477; 8/543; 8/549; 8/602; 8/918

[58] Field of Search ..... 8/549, 602, 477

[56] References Cited

U.S. PATENT DOCUMENTS 4,604,099 8/1986 Berendt et al. ..... 8/477

FOREIGN PATENT DOCUMENTS 2836417 8/1979 Fed. Rep. of Germany .
3834966 4/1989 Fed. Rep. of Germany .
2032468 5/1980 United Kingdom .

*Primary Examiner*—A. Lionel Clingman
*Attorney, Agent, or Firm*—Marla J. Mathias; Edward McC. Roberts

[57] ABSTRACT

There is disclosed a process for printing cellulosic textile material with reactive dyes which contain at least one monohalotriazine radical, which process comprises printing said material, without the addition of urea, in a single step and wetting the dried printed goods with water for the fixation step.

The novel process gives level and deep prints of excellent appearance without the use of urea.

20 Claims, No Drawings

PROCESS FOR PRINTING CELLULOSIC TEXTILE MATERIAL WITH REACTIVE DYES: PRINT PASTE FREE OF UREA; WETTING OF DRIED PRINTED FABRIC PRIOR TO FIXING

The present invention relates to a process for printing cellulose textile material with reactive dyes which contain at least one monohalotriazine group, in which process printing is carried out in a single step without the addition of urea.

It has long been known, for example from U.S. Pat. No. 4,604,099, to print cellulosic materials with reactive dyes. In the known processes, it is necessary to use substantial amounts of urea, which is responsible, inter alia, for enhancing dye solubility and, most especially, for a sufficient degree of fixation.

However, aside from these favourable properties for the printing, dyeing and fixing process with reactive dyes, urea constitutes a substantial pollution factor in the wastewaters. There has therefore been no lack of efforts to reduce the amount of, or to eliminate, the urea or to find substitutes for it. The results have, however, been unsatisfactory.

Surprisingly, it has now been found that it is possible to print cellulosic textile material with reactive dyes, without the addition of urea, to give coloured prints with a high degree of fixation.

Accordingly, the present invention relates to a process for printing cellulosic textile material with reactive dyes which contain at least one monohalotriazine radical, which process comprises printing said material, without the addition of urea, in a single step and wetting the dried printed goods with water for the fixation step.

The invention further relates to the cellulosic textile material printed by the inventive process.

The dyes used in the process of this invention are reactive dyes which contain a monohalotriazine group and which are suitable for dyeing or printing cellulosic textile materials.

The monohalotriazine group is a monofluorotriazine, monobromotriazine or, preferably, a monochlorotriazine group.

The amount of dye will normally depend on the desired colour strength and is conveniently 0.1 to 300 g/kg, preferably 0.1 to 100 g/kg and, most preferably, 5 to 60 g/kg of print paste.

When reactive dyes are used, the print pastes will normally contain a fixing alkali. Alkalies which may be suitably used for fixing the reactive dyes are typically sodium carbonate, sodium hydrogencarbonate, sodium hydroxide, disodium phosphate, trisodium phosphate, borax, aqueous ammonia or alkali donors such as sodium trichloroacetate or sodium formate. A mixture of water glass and a 25% aqueous solution of sodium carbonate can also be used as alkali.

The alkali-containing print pastes normally have a pH in the range from 7.5 to 13.2, preferably from 8.5 to 11.5.

In addition to the dyes, the aqueous print pastes used for the inventive process also contain a thickener, preferably of natural origin, by itself or in admixture with modified cellulose, most preferably with at most 25% by weight of carboxymethyl cellulose. If desired, the print pastes contain preservatives, chelating agents, emulsifiers, water-insoluble solvents, oxidising agents and deaerating agents.

Particularly suitable preservatives are formaldehyde donors such as paraformaldehyde and trioxane, especially ca. 30 to 40% aqueous formaldehyde solutions. Suitable chelating agents are typically sodium nitrilotriacetate, sodium ethylenediaminetetraacetate, preferably sodium polymethaphosphate, most preferably sodium hexamethaphosphate. Particularly suitable emulsifiers are polyadducts of an alkylene oxide with a fatty alcohol, preferably a polyadduct of oleyl alcohol with ethylene oxide. Suitable water-insoluble solvents are high-boiling saturated hydrocarbons, preferably paraffins having a boiling range of ca. 160° to 210° C. (white spirits). Suitable oxidising agents are typically aromatic nitro compounds, preferably an aromatic mono- or dinitrocarboxylic acid or mono- or dinitrosulfonic acid which may be in the form of a polyadduct of ethylene oxide, especially a nitrobenzenesulfonic acid. Suitable deaerating agents are typically high-boiling solvents, preferably terpentine oils, higher alkanols, preferably $C_8$–$C_{10}$alcohols, terpene alcohols or deaerating agents based on mineral and/or silicone oils, preferably commercial formulations of ca. 15 to 25% by weight of a mineral and silicone oil mixture and ca. 75 to 85% by weight of a $C_8$alcohol such as 2-ethyl-n-hexanol.

The process of the present invention is suitable for printing textiles which consist of, or contain, cellulose.

The textile materials are in particular flat textile structures such as nonwovens, felts, carpets, woven goods and, preferably, knitted goods. The process of the invention is suitable for fibre materials which have been treated with aqueous sodium hydroxide, preferably for cellulosic material and regenerated cellulose such as viscose rayon.

For printing the fibre materials, the print paste is applied direct to the whole or part of the surface, conveniently using printing machines of conventional make, for example rotogravure, rotary screen printing and surface screen printing machines.

After it has been printed in the temperature range up to 150° C., the fibre material is preferably dried at 80° to 120° C. Before fixing the dyes, the fibre material is wetted on the face, on the back or on both sides with water. This wetting with water may be effected in different ways, for example by direct or indirect methods of application. The fibre material can be wetted direct by spraying with a commercial atomiser, by roller systems, with screens or by applying water in the form of foam, or by rotary wetting, the principle of which is described in detail in Textilpraxis International, 111a (1987). Wetting can be carried out indirectly by contacting the fibre material to be fixed with a cloth which is moistened with water. The cloth acts here as moisture carrier. The amount of water applied is in the range from 5 to 50% by weight, preferably from 10 to 40%, based on the printed, dry fibre material.

After the wetting, the dyes are fixed on the material. Fixing is effected by subjecting the material to a heat treatment in the temperature range from preferably 100° to 220° C. The heat treatment is normally carried out with steam under atmospheric pressure.

The fibre material is thereafter normally given a washing off with cold and then hot water, if desired followed by a further washing off with cold water.

The process of this invention gives level, full-shade coloured prints of excellent appearance. In particular, the fixing step of this invention makes it possible to obtain coloured prints with reactive dyes on cellulosic textile materials, especially viscose rayon, without the addition of urea, which is normally used in substantial amounts.

32 g/kg of a commercial liquid mixture of the dyes of formulae (103)

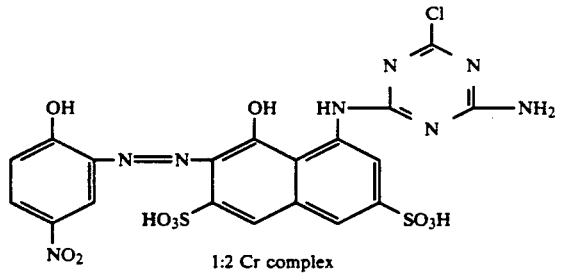

1:2 Cr complex and (104)

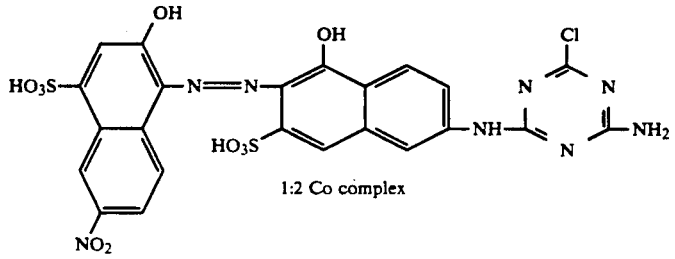

1:2 Co complex

| | |
|---|---|
| 8.9 g/kg | of sodium m-nitrobenzenesulfonate |
| 89 g/kg | of 25% $Na_2CO_3$ solution |
| 490 g/kg | of 6% sodium alginate solution |
| 1.8 g/kg | of a deaerating agent, and |
| 321.3 g/kg | of water. |

In the following Examples, parts and percentages are by weight unless otherwise stated.

EXAMPLE 1

Causticised viscose rayon is printed on-shade with a print paste comprising 7 g/kg of a commercial powdered formulation of the dye of formula (101)

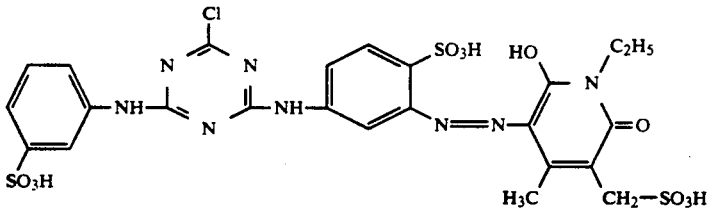

50 g/kg of a commercial liquid formulation of the dye of formula (102)

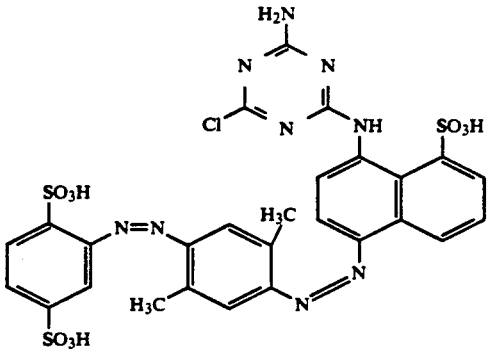

dried for one minute at 120° C., wetted with water using a minimum-liquor applicator (amount: 30%, based on the weight of the material), then steamed in a steamer for 8 minutes at 105° C. at atmospheric pressure, and subsequently washed with cold and then with boiling water until unfixed dye and the auxiliaries have been removed.

After drying the material at 90°-120° C., a deep brown print is obtained.

Repetition of the above procedure, but without wetting the material before steaming, gives a spoiled, very weak print, as under these conditions only insignificant fixation takes place.

EXAMPLE 2

Bleached, causticised viscose rayon is printed with a print paste comprising 25 g/kg of a commercial granular formulation of the dye of formula (105)

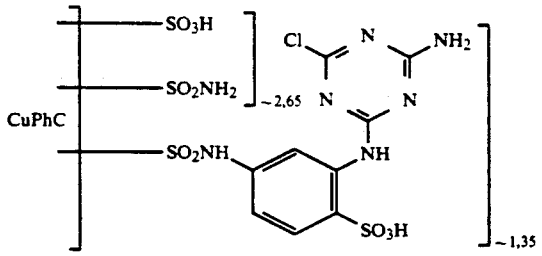

9 g/kg of sodium m-nitrobenzenesulfonate
60 g/kg of 25% $Na_2CO_3$ solution
406 g/kg of water, and
500 g/kg of 6% sodium alginate solution.

The printed material is dried normally, such that the total moisture content after drying is 5.5%, based on the weight of the material. A further 45% of water is then applied from a spray jet and the wetted material is treated in a steamer for 8 minutes under atmospheric pressure at a temperature of 115° C., and thereafter washed with cold and with boiling water until unfixed dye and the auxiliaries have been removed. After drying, a full, turquoise shade is obtained.

If the printed material is steamed immediately after drying without spray wetting, the resultant shade is 60% weaker and therefore spoiled.

The desired colour strength without additional wetting is only obtained by adding 150 g/kg of urea.

EXAMPLE 3

A print paste of the following composition is prepared:

40 g of a commercial granular formulation of the dye of formula (106)

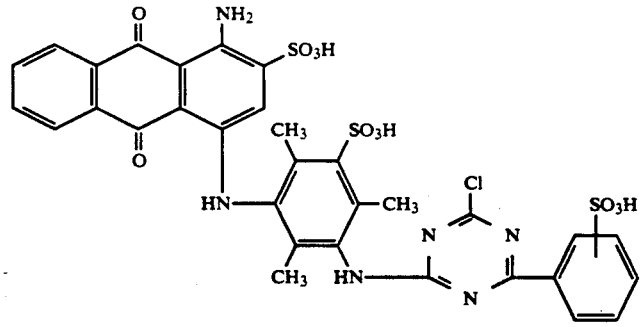

are added, with stirring, to 960 g of a stock thickening comprising
9.5 g of sodium m-nitrobenzenesulfonate
60 g of 25% $Na_2CO_3$ solution
410.5 g of water, and
480 g of 6% sodium alginate solution and the print paste so obtained is printed on bleached, mercerised cotton knitwear and dried to a residual moisture content of 3.5%, based on the weight of the goods.

The printed material is wetted with water from a spray jet to a residual moisture content of 50%, based on the weight of the dry goods, immediately before being steamed for 8 minutes in a steamer under atmospheric pressure at 115° C. After a conventional washing-off, a deep, royal blue print is obtained.

The print is markedly weaker in shade and unlevel if the material is not additionally wetted before steaming.

EXAMPLE 4

A cellulosic material is printed and dried as described in Example 2. The water content is in this case only 10% (instead of 45%), based on the weight of the goods. In the subsequent steam treatment the temperature is kept at 102° C. The steaming time is 8 minutes. The turquoise shade obtained after the washing-off has the same colour strength as in Example 2. Omission of the wetting results in a 40% weaker print.

Only the addition of 100 g/kg of urea gives a comparably deep shade without wetting the material before steaming.

What is claimed is:

1. A process for printing cellulosic textile material which comprises:

(a) printing a textile material with a fiber-reactive dye containing at least one monohalotriazine radical, the printing being carried out in a single step and in the absence of urea, (b) drying the printed textile material, (c) wetting the dried printed material with water, and (d) subsequently fixing the dye with steam under atmospheric pressure.

2. A process according to claim 1, wherein the at least one monohalotriazine radical is selected from the group consisting of monofluorotriazine, monobromotriazine and monochlorotriazine.

3. A process according to claim 1, wherein the fiber-reactive dye is present in a print paste in an amount between about 0.1 to 300 g dye/kg print paste.

4. A process according to claim 3, wherein the print paste includes a fixing alkali.

5. A process according to claim 4, wherein the fixing alkali is selected from the group consisting of sodium carbonate, sodium hydrogen carbonate, sodium hydroxide, disodium phosphate, trisodium phosphate, borax, aqueous ammonia, sodium trichloroacetate and sodium formate.

6. The process according to claim 4, wherein the print paste has a pH in the range of about 7.5 to about 13.2.

7. The process according to claim 6, wherein the print paste has a pH in the range of about 8.5 to 11.5.

8. The process according to claim 1, wherein the printing of step (a) occurs at a temperature of less than 150° C.

9. The process according to claim 1, wherein the drying of the printed textile material in step (b) occurs at a temperature of between about 80° C. and 120° C.

10. The process according to claim 1, wherein the dried printed material has a face surface and a back surface, and is wetted in step (c) on the face surface, on the back surface or on both surfaces of the material.

11. The process according to claim 1, wherein the dried printed material is directly wetted in step (c) by spraying with a commercial atomizer, by using roller systems or screens, by applying foam which contains water, or by rotary wetting.

12. The process according to claim 1, wherein the dried printed material is indirectly wetted in step (c) by contacting the dried printed material with a cloth which is moistened with water.

13. The process according to claim 1, wherein the amount of water with which the dried printed material is wetted in step (c) weighs between about 5 to 50% of the dried printed material.

14. The process according to claim 13, wherein the amount of water with which the dried printed material is wetted in step (c) weighs between about 10 to 40% of the dried printed material.

15. The process according to claim 1, wherein the fixing of the dye in step (d) occurs at a temperature of between about 100° and 200° C.

16. The process according to claim 1, further including the steps of (e) washing the printed material with cold water, and (f) subsequently washing the printed material with hot water.

17. The process according to claim 16, further including the step of (g) washing the printed material again with cold water.

18. A process according to claim 7, wherein the cellulosic material used is regenerated cellulose.

19. A process according to claim 7, wherein the cellulosic material used is viscose rayon.

20. Printed textile material obtained by a process as claimed in claim 7.

* * * * *